US010332676B2

(12) United States Patent
Teggatz et al.

(10) Patent No.: US 10,332,676 B2
(45) Date of Patent: Jun. 25, 2019

(54) COUPLED INDUCTOR SYSTEM HAVING MULTI-TAP COIL

(75) Inventors: Ross Teggatz, McKinney, TX (US); Wayne Chen, Plano, TX (US); Amer Atrash, Richardson, TX (US); Jonathan Knight, Osaka (JP)

(73) Assignee: TRIUNE SYSTEMS, LLC, Plano, TX (US)

( * ) Notice: Subject to any disclaimer, the term of this patent is extended or adjusted under 35 U.S.C. 154(b) by 556 days.

(21) Appl. No.: 13/430,338

(22) Filed: Mar. 26, 2012

(65) Prior Publication Data

US 2012/0242164 A1 Sep. 27, 2012

Related U.S. Application Data

(60) Provisional application No. 61/467,022, filed on Mar. 24, 2011.

(51) Int. Cl.

| | |
|---|---|
| ***H01F 27/42*** | (2006.01) |
| ***H01F 38/00*** | (2006.01) |
| ***H01F 38/14*** | (2006.01) |
| ***H01F 21/12*** | (2006.01) |

(52) U.S. Cl.

CPC ..... *H01F 38/14* (2013.01); *H01F 21/12* (2013.01)

(58) Field of Classification Search

USPC ..... 307/104

See application file for complete search history.

(56) References Cited

U.S. PATENT DOCUMENTS

| | | | | |
|---|---|---|---|---|
| 6,538,394 | B2 | 3/2003 | Volk et al. | |
| 7,250,810 | B1 | 7/2007 | Tsen | |
| 7,991,282 | B1 | 8/2011 | McIntyre et al. | |
| 8,077,139 | B2 | 12/2011 | Chang et al. | |
| 8,247,990 | B1 * | 8/2012 | Gordin et al. | 315/291 |
| 2009/0108775 | A1 | 4/2009 | Sandner et al. | |
| 2009/0121653 | A1 | 5/2009 | Chida | |
| 2010/0327928 | A1 | 12/2010 | Li et al. | |
| 2011/0181121 | A1 * | 7/2011 | Kolavennu | H02J 5/005 307/104 |
| 2011/0193416 | A1 * | 8/2011 | Campanella | H01Q 7/00 307/104 |
| 2011/0291489 | A1 * | 12/2011 | Tsai et al. | 307/104 |
| 2012/0139358 | A1 * | 6/2012 | Teggatz et al. | 307/104 |

* cited by examiner

*Primary Examiner* — Rexford N Barnie
*Assistant Examiner* — Dru Parries
(74) *Attorney, Agent, or Firm* — Jackson Walker LLP; Christopher J. Rourk; Thomas B. Hayes

(57) ABSTRACT

Coupled inductor signal transfer systems are disclosed in which transmitter and receiver coils are inductively coupled in a configuration for wirelessly transferring power and/or data signals. In preferred implementations, the systems may be used for transmitting both power and data. Preferred embodiments of the invention have at least one multi-tap coil on the primary side and/or secondary side of the system. The selection of taps enables the effective size and/or number of coils to be dynamically changed according to operational needs.

20 Claims, 2 Drawing Sheets

COUPLED INDUCTOR SYSTEM HAVING MULTI-TAP COIL

PRIORITY ENTITLEMENT

This application is entitled to priority based on Provisional Patent Application Ser. No. 61/467,022 filed on Mar. 24, 2011, which is incorporated herein for all purposes by this reference. This application and the Provisional Patent Application have at least one common inventor.

TECHNICAL FIELD

The invention relates to coupled inductor systems. More particularly, the invention relates to coupled inductor systems for use in wireless power and data transfer applications. In preferred embodiments employed in wireless power applications, the invention relates to the more efficient utilization of energy resources.

BACKGROUND OF THE INVENTION

Inductive coupling is an effect used to transfer electrical energy from one circuit to an adjacent circuit through inductive coils. A variable current on a primary coil is used to create a varying magnetic field, and thus a voltage, in a secondary coil. Wireless charging systems employing inductive coupling are useful for transferring energy from one device to another. Such systems are used for supplying power, charging batteries, and in some cases also for transferring data. Challenges inherent in such systems include providing efficiency in transferring signals. Inefficient systems generate excess heat and are limited in their maximum signal transfer capability. Existing systems accomplish signal transfer by exciting a primary side coil and receiving with a secondary side coil within a given frequency and amplitude range. Typically, the maximum signal amplitude that can be transferred is limited by the primary side driver amplitude and frequency as well as the inductance of the coils and the coupling between coils. Typically, any given signal transfer coil is only optimized for a small range of signal amplitude transfer levels. Operating the coils outside this narrow range tends to result in reduced efficiency and/or reduced coupling between coils.

Due to these and other problems and potential problems, improved coupled inductor systems would be useful and advantageous contributions to the arts. In particular, systems capable of supporting a wide range of amplitude transfer levels, e.g., milliWatts to 100's of Watts, from a single primary and/or secondary side hardware unit would be highly useful.

SUMMARY OF THE INVENTION

In carrying out the principles of the present invention, in accordance with preferred embodiments, the invention provides advances in the arts with novel apparatus directed to the transfer of power and/or data using inductive couplings. In preferred embodiments, systems include capabilities for power and/or data transfer. Preferably, the coupled coils of systems of the invention are not permanently physically interconnected.

According to aspects of the invention, examples of preferred embodiments include coupled inductor systems including at least a primary side coil and a secondary side coil for completing an inductive coupling. The coils are preferably not permanently physically affixed to one another. When positioned in proximity, the primary and secondary side coils are electromagnetically, but not physically coupled such that one or more signals may be passed between the coils.

According to aspects of the invention, in an example of presently preferred embodiments, a coupled inductor system for wireless signal transfer includes a primary side with a driver connected for driving a primary side coil. A secondary side is provided with a secondary side coil and is adapted for receiving a signal transmitted to it through the primary side coil. At least one of the coils includes multiple taps which may be selected for reconfiguring the coil according to desired signal transfer parameters.

According to aspects of the invention, preferred embodiments include a coupled inductor system for wireless signal transfer in which a primary side coil includes a plurality of taps.

According to aspects of the invention, preferred embodiments include a coupled inductor system for wireless signal transfer in which a secondary side coil includes a plurality of taps.

According to aspects of the invention, preferred embodiments of coupled inductor systems for wireless signal transfer include both power and data transfer capabilities.

According to aspects of the invention, in preferred embodiments, coupled inductor systems for wireless signal transfer are also equipped for providing feedback from the secondary side to the primary side.

The invention has advantages including but not limited to one or more of, improved coupled inductor system power transfer, improved data transmission functionality, and reduced costs. These and other potential advantageous, features, and benefits of the present invention can be understood by one skilled in the arts upon careful consideration of the detailed description of representative embodiments of the invention in connection with the accompanying drawings.

BRIEF DESCRIPTION OF THE DRAWINGS

The present invention will be more clearly understood from consideration of the following detailed description and drawings in which.

References in the detailed description correspond to like references in the various drawings unless otherwise noted. Descriptive and directional terms used in the written description such as right, left, back, top, bottom, upper, side, et cetera, refer to the drawings themselves as laid out on the paper and not to physical limitations of the invention unless specifically noted. The drawings are not to scale, and some features of embodiments shown and discussed are simplified or amplified for illustrating principles and features as well as advantages of the invention.

DESCRIPTION OF PREFERRED EMBODIMENTS

The present patent application is related to U.S. patent application Ser. No. 13/045,493 which shares at least one common inventor with the present application and has a common assignee. Said related application is hereby incorporated herein for all purposes by this reference.

If a load is connected to the secondary coil of a coupled inductor system, an electric current flows in the secondary coil, and electrical energy is then transferred from the primary coil through the secondary coil, and ultimately to a load connected to the secondary side. Generally, secondary side systems are designed to resonate at a particular frequency. This allows for more efficient transfer of energy at that particular frequency.

The inventors have designed a system in which primary side coils for inductively coupled coil systems use a coil having several tap points instead of two taps as conventionally used. The drive point, and therefore the portion of the coil that is excited can be adjusted based on the amplitude of signal transfer required. This changes the effective impedance of the coil. If the system needs high amplitude transfer, the full coil can be used. When practical, using a coil with a higher inductance value allows for more voltage to be applied across the coil while maintaining similar current levels. If a smaller amplitude signal is needed, then a smaller portion of the coil can be used. Using a smaller coil results in reduced losses from the series resistance of the coil(s). Additional capacitors or other elements associated with the coil(s) can be switched in and out of the system to maintain the optimized resonant frequency of the system as the coil impedance changes.

Figure 1:
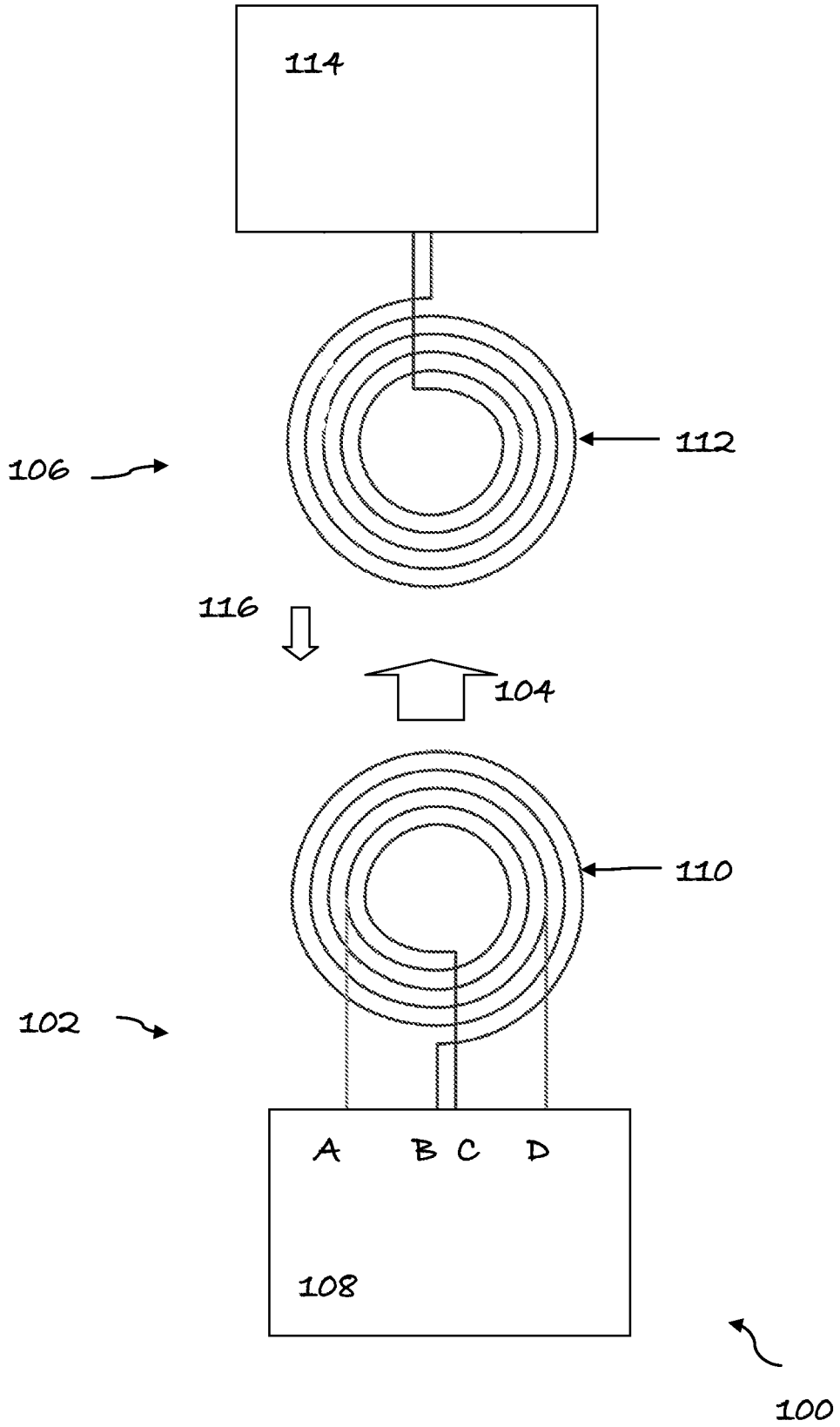
FIG. 1 is a simplified schematic diagram of a coupled inductor signal transfer system illustrating an example of a preferred embodiment of the invention.

An example of a preferred embodiment of a coupled inductor system for wireless signal transfer according to the invention is shown in FIG. 1. The system 100 includes a primary side 102 for providing a signal 104 to a secondary side 106 receiver. On the primary side 102, a signal generator 108 is provided as a driver. Preferably, the signal generator 108 is capable of adjustment in terms of frequency and amplitude in order to adjust transmissions to the secondary side 104. Suitable startup circuitry is provided, preferably within the signal generator 108, to allow the system 100 to achieve appropriate bias levels prior to driving the primary side inductor coil 110. This provides the additional advantage of providing a smooth startup that mitigates or eliminates wasted energy and radiated emissions. The primary side coil 110 includes multiple taps, in this example four taps indicated in FIG. 1 as A, B, C, and D. The multiple taps are selectable using suitable switches within the primary side circuitry 108 selectable according to operational criteria. Various numbers and locations of taps may be used to effectively provide a range of coils anticipated to be useful for particular operating conditions. The secondary side 106 includes a secondary side inductor 112, inductively coupled to the primary side inductor 110 for receiving the output of the primary side 102. Preferably, the secondary side 104 also includes circuitry 114 suitable for generating feedback signals 116 such as amplitude levels, load levels, and secondary side frequency, for use in making adjustments to the output of the primary side driver 108.

It should be understood that the system 100 frequency may be adjusted in efforts to optimize signal transfer. If the amplitude of the output 104 is measured at different frequencies and found to vary in amplitude, then the frequency with the highest amplitude signal is recognized to represent the resonant point of the system 100 and may be used to optimize operation. The frequency at the primary side 102 signal generator 108 can also be adjusted to optimize the coupling to the secondary side 106. Preferably, during initial coupling, the frequency of the primary transmission is varied, and data and/or power transfer, preferably both, are measured in the secondary side 106 at various frequencies. The feedback information 116 thus obtained may then be used to determine the optimal frequency of the output of the driver 108 for maximum signal transfer. The system 100 can also employ a multi-step setup using multiple parameters. For example, on initial power-up or characterization, the primary side 102 of the system 100 can determine its resonant frequency by iteratively adjusting frequency and measuring output at the primary side coil 110. After the signal transfer link is established at some defined frequency, the system 100 operating frequency can shift back to the resonant frequency based on feedback 116 from the secondary side 106 for improved efficiency. At this point, the signal transfer can be controlled by adjusting the signal generator 108 amplitude and maintaining operation at the resonant frequency. Instead of using the resonant frequency, the system 100 can optionally make use of one or more other selected frequency determined to be a preferred frequency based on efficiency, signal transfer, EMI, or other parameter(s).

This exemplary coupled inductor system 100 for wireless signal transfer illustrates several advantages common to preferred embodiments of the invention. The available taps on the multi-tap coil permit selection of coil characteristics in real time based on operational conditions and objectives. Aspects of the invention lead to improved control and efficiency, including, low impedance switches, accurate signal generation, feedback to compensate for variations in secondary side load, precise control of the primary side coil voltage amplitude, and additional data transfer capabilities. As the energy transfer is improved, the coil resistance can be higher making a better system in terms of manufacturability and lower cost. The feedback loop provided to assist in generating the primary side transmission can be implemented using voltage or current feedback or some combination of both. An additional advantage of this system is that it provides the ability to generate an effective coil drive voltage and/or amplitude that is lower than the input voltage of the system. This eliminates the need for a separate power conversion stage that would be necessary to modulate input voltage to the primary coil driver.

Figure 2:
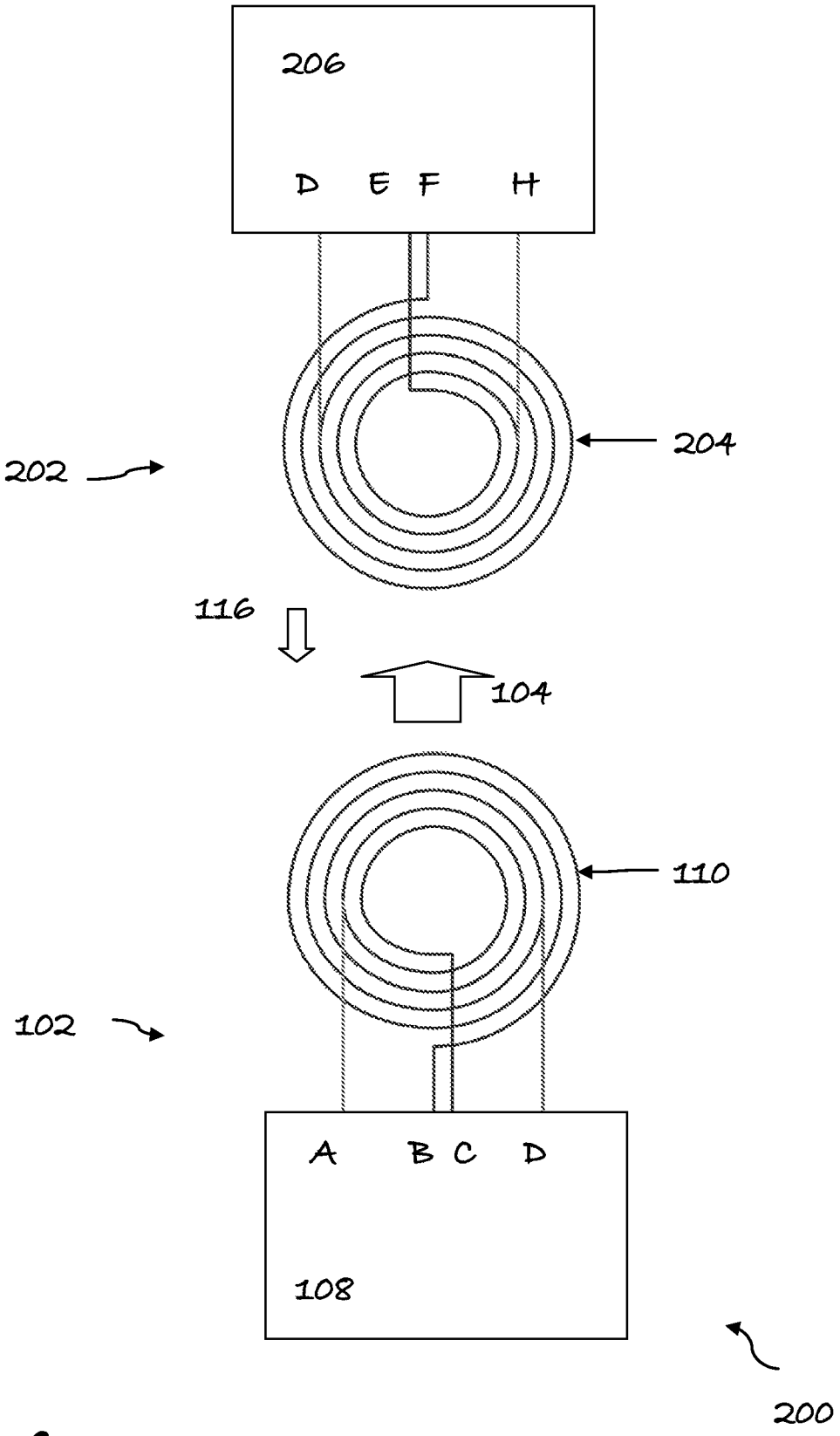
FIG. 2 is a simplified schematic diagram of a coupled inductor signal transfer system illustrating an example of a preferred embodiment of the invention.

An analogous configuration may be used on the secondary (receiver) side of a system. FIG. 2 provides an illustration representative of an example of such a system 200. As shown, the primary side 102 in this example is configured as described with reference to FIG. 1. The secondary side 202 is configured in a similar manner. A secondary side coil 204 is provided with multiple taps, in this example four, E, F, G, and H, which may be selected by suitable switching mechanisms within the secondary side receiver circuitry 206. The amplitude of a received signal, e.g., 104, is a function of the receiver coil 204. If the incoming signal 104 is not dissipated safely, it can generate a high voltage at the secondary coil terminals, e.g., E, F, G, H, in various combinations, and damage circuitry 206 connected to the coil 204. This can be a particular problem during system 200 startup before the signal transfer level has been established. Providing the secondary receiver coil 204 with multiple taps E, F, G, H, permits the actual physical size of the receiver coil(s) 204 to be switchably selected in order to control the amplitude of the signal received at the selected coil(s) 204. In operation, the system 200 preferably is initiated to start at a low amplitude setting and then switches to a higher amplitude setting after the signal transmission/reception matchup has been safely configured. Several suitable capacitors may be provided within the receiver circuitry 206 to be switched in as needed to maintain the appropriate resonant frequency of the receiver 206 as the coil 204 impedance changes.

It should be appreciated by those skilled in the arts that in either the primary side or secondary side coils for coupled inductor systems according to the principles of the invention, in a coil with multiple taps, any subset of the coil may be used based on selection from among the taps using appropriate switching circuitry. This allows a single coil to be used to provide a large number of possible configurations. In addition, sub-portions of the coil may be configured for different architectures. The portions may be reconfigured to be in parallel. Alternatively, the separate portions of the same coil may be driven into different receiver systems to provide multiple power and/or data receivers using the same coil. The amplitude of the signal available to each receiver can be adjusted by changing which tap points of the coil are used.

Another way to use the multi-tap system is to adjust the resonance of the receiver based on load. As the load of the receiver or the coil alignment changes, the effective impedance of the system also changes. The receiver dynamically adjusts its impedance by selecting the appropriate coil taps and/or switching in or out capacitors in order to maintain good coupling. This can be done using various search algorithms, such as a binary search, walking through the available settings, successive approximation, or look-up-table type techniques. The system can repeat the search to re-tune itself periodically to guarantee that optimum performance is maintained. A similar technique can also be applied on the transmitter side. A similar search can also be performed in order to select coil taps to use for a given signal on the transmitter or the receiver. Preferably, the system is used beginning with using the coil taps with the minimum amplitude and thereafter searching for the coil tap configuration that provides the optimum signal transfer under the given circumstances.

A similar technique may be applied to the primary side coil driver on the transmitter side of a system. The coil driver, e.g. 108, is preferably built up of several smaller drivers in parallel, such that all or any number or combination of the drivers may be used during system operation. In the event low amplitude is required, then few drivers are preferably used. Using fewer drivers improves the efficiency of the system by reducing the switching losses associated with the control and pre-drive for the switches. For higher amplitude operation, more drivers are used. This reduces the effective impedance of the driver and allows for more efficient signal transfer. The selection of drivers used can be changed dynamically based on any of several parameters, including drive current, system temperature, and desired output amplitude.

In many portable electronic systems, battery operated products will not allow charging unless they receive sufficient charge current. This creates a problem for wireless charging systems where the maximum instantaneous power transfer may be limited by the transmitter or by the coil alignment. A solution to this is a receiver, e.g. 206, that operates intermittently. The receiver stores incoming power in an energy storage device (such as a capacitor, supercapacitor, inductor, small battery, or any other energy storage element) until enough energy is available to provide the necessary charging current for the system. Then, the receiver uses the stored energy to provide charge to an associated energy storage system. After the stored energy has been transferred out of the temporary storage element(s), the receiver stops the charging and continues receiving power and storing it in the storage elements and the cycle repeats. The receiver preferably manages the incoming power so that it presents a uniform load to the system.

An additional advantage of the invented coupled inductor signal transmission system having multi-tap coils is the ability to transmit data as well as power. For example, a PWM signal may be used in the system to transfer power, and may also be modulated to include data. The modulation can be amplitude, duty cycle, frequency, or other modulation technique. For example, the primary side 102 can be switched at two different frequencies. A selected number of pulses at a lower frequency when detected at the secondary side 202 receiver 206 can represent a "one" and a selected number of pulses at a higher frequency when detected at the receiver 206 can represent a "zero".

In another example of data transmission in a coupled inductor signal transmission system of the invention, two coils on the primary side 102 can be driven in parallel using the same driver. Using a different coil and/or capacitor combination results in a different frequency response. The coil/capacitor combinations can be tuned such that one is optimized for power transmission at a sine wave frequency (lower frequency), for example, and the other is optimized for data transmission at the driver switching frequency (higher frequency). The coils in this approach provide a filter to eliminate unwanted frequency content. A similar approach can be used on the receiver-side of this system. Two coils in parallel can be used and tuned to the appropriate frequencies. Such multi-coil systems can be implemented using combinations of the coupled coil systems shown and described herein without departure from the invention.

While the making and using of various exemplary embodiments of the invention are discussed herein, it should be appreciated that the present invention provides inventive concepts which can be embodied in a wide variety of specific contexts. It should be understood that the invention may be practiced with coupled inductor systems having communications and power transfer functionality, such as for example, battery chargers, AC/DC converters, power supplies, and associated apparatus. For purposes of clarity, detailed descriptions of functions, components, and systems familiar to those skilled in the applicable arts are not included. The methods and apparatus of the invention provide one or more advantages including but not limited to, data transfer capabilities, managed power transfer capabilities, and enhanced energy utilization and conservation attributes. While the invention has been described with reference to certain illustrative embodiments, those described herein are not intended to be construed in a limiting sense. For example, variations or combinations of steps or materials in the embodiments shown and described may be used in particular cases without departure from the invention. Various modifications and combinations of the illustrative embodiments as well as other advantages and embodiments of the invention will be apparent to persons skilled in the arts upon reference to the drawings, description, and claims.

We claim:

1. A coupled inductor system for wireless signal transfer comprising:

a primary side having a driver operably coupled to a primary side coil;

a secondary side having a secondary side coil operably coupled to receiver circuitry;

whereby a signal may be transmitted by the primary side and received by the secondary side;

wherein at least one of the coils further comprises more than two taps adapted for reconfiguring the coil, and wherein the primary side is adapted to transmit a data signal and a power signal and the driver is configured to determine a tap setting associated with an optimal power and data transfer; and wherein the primary side further comprises circuitry configured to generate secondary side amplitude level feedback signals, secondary side load level feedback signals, and secondary side frequency feedback signals generated in response to the secondary side receiving the power signal from the primary side and providing feedback in response, wherein primary side driver is configured to receive the secondary side amplitude level feedback signals, the secondary side load level feedback signals, and the secondary side frequency feedback signals and to reconfigure the tap setting for optimal power and data transfer to make adjustments in an output of the primary side driver in response.

2. A coupled inductor system for wireless signal transfer according to claim 1 wherein the primary side coil comprises more than two taps.

3. A coupled inductor system for wireless signal transfer according to claim 1 wherein the secondary side coil comprises more than two taps.

4. A coupled inductor system for wireless signal transfer according to claim 1 further comprising feedback circuitry adapted to determine the resonant frequency of the primary side and to operate the driver at the resonant frequency.

5. A coupled inductor system for wireless signal transfer according to claim 1 wherein the primary side driver further comprises frequency adjustment circuitry.

6. A coupled inductor system for wireless signal transfer according to claim 1 wherein the primary side driver further comprises switching circuitry operably coupled to the primary side coil.

7. A coupled inductor system for wireless signal transfer according to claim 1 wherein the secondary side receiver further comprises switching circuitry operably coupled to the secondary side coil.

8. A coupled inductor system for wireless signal transfer according to claim 1 wherein the secondary side receiver further comprises a plurality of capacitors operably coupled to the secondary side coil.

9. A coupled inductor system for wireless signal transfer comprising:

a primary side having a driver operably coupled to a primary side coil, the primary side coil having more than two taps selectably coupled to the driver and a signal generator configured to determine a tap setting that corresponds to optimal data and power transfer; and a secondary side having a secondary side coil operably coupled to receiver circuitry;

whereby a data signal and a power signal is transmitted by the primary side and received by the secondary side; and wherein the primary side is configured to receive amplitude level feedback signals, load level feedback signals, and secondary side frequency feedback signals received in response to the secondary side receiving at least one signal from the primary side and providing feedback in response and to reconfigure the tap setting for optimal power and data transfer to make adjustments in an output of the primary side driver in response.

10. A coupled inductor system for wireless signal transfer according to claim 9 wherein the primary side driver further comprises frequency adjustment circuitry.

11. A coupled inductor system for wireless signal transfer according to claim 9 wherein the primary side driver further comprises amplitude level adjustment circuitry.

12. A coupled inductor system for wireless signal transfer according to claim 9 wherein the primary side driver further comprises load level adjustment circuitry.

13. A coupled inductor system for wireless signal transfer according to claim 9 wherein the primary side is adapted to transmit a power signal.

14. The coupled inductor system for wireless signal transfer according to claim 1 wherein the power signal is modulated for transmission to include the data signal.

15. The coupled inductor system for wireless signal transfer according to claim 9 wherein the power signal is modulated for transmission to include the data signal.

16. The coupled inductor system for wireless signal transfer according to claim 9 wherein the secondary side coil comprises more than two taps.

17. The coupled inductor system for wireless signal transfer according to claim 9 further comprising feedback circuitry adapted to determine the resonant frequency of the primary side and to operate the driver at the resonant frequency.

18. The coupled inductor system for wireless signal transfer according to claim 9 wherein the primary side driver further comprises switching circuitry operably coupled to the primary side coil.

19. The coupled inductor system for wireless signal transfer according to claim 9 wherein the secondary side receiver further comprises switching circuitry operably coupled to the secondary side coil.

20. The coupled inductor system for wireless signal transfer according to claim 9 wherein the secondary side receiver further comprises a plurality of capacitors operably coupled to the secondary side coil.

* * * * *